US010249429B2

(12) United States Patent
Arimitsu et al.

(10) Patent No.: US 10,249,429 B2
(45) Date of Patent: Apr. 2, 2019

(54) COIL DEVICE

(71) Applicant: TDK CORPORATION, Tokyo (JP)

(72) Inventors: Kazunori Arimitsu, Tokyo (JP); Shunpei Kikuchi, Tokyo (JP); Akiumi Oba, Tokyo (JP)

(73) Assignee: TDK CORPORATION, Tokyo (JP)

( * ) Notice: Subject to any disclaimer, the term of this patent is extended or adjusted under 35 U.S.C. 154(b) by 133 days.

(21) Appl. No.: 15/618,812

(22) Filed: Jun. 9, 2017

(65) Prior Publication Data

US 2018/0012699 A1 Jan. 11, 2018

(30) Foreign Application Priority Data

Jul. 7, 2016 (JP) ..... 2016-135228

(51) Int. Cl.

| | |
|---|---|
| ***H01F 27/30*** | (2006.01) |
| ***H01F 27/29*** | (2006.01) |
| ***H01F 27/24*** | (2006.01) |
| ***H01F 27/28*** | (2006.01) |
| ***H01F 17/04*** | (2006.01) |
| ***H01F 27/02*** | (2006.01) |
| ***H01F 27/255*** | (2006.01) |

(52) U.S. Cl.

CPC ..... *H01F 27/29* (2013.01); *H01F 17/04* (2013.01); *H01F 27/022* (2013.01); *H01F 27/24* (2013.01); *H01F 27/255* (2013.01); *H01F 27/2828* (2013.01); *H01F 27/292* (2013.01); *H01F 27/30* (2013.01); *H01F 2017/048* (2013.01)

(58) Field of Classification Search

CPC ..... H01F 27/00–27/36

USPC ..... 336/65, 83, 192, 200, 232

See application file for complete search history.

(56) References Cited

U.S. PATENT DOCUMENTS

| | | | | |
|---|---|---|---|---|
| 5,457,872 | A * | 10/1995 | Sakata | H01F 27/292 29/605 |
| 5,548,264 | A * | 8/1996 | Teshima | H01F 27/027 336/192 |
| 8,922,317 | B2 * | 12/2014 | Yamada | H01F 17/043 336/192 |
| 2014/0266541 | A1 * | 9/2014 | Sakamoto | H01F 27/29 336/192 |
| 2016/0055961 | A1 * | 2/2016 | Gu | H01F 17/04 336/192 |
| 2016/0126006 | A1 * | 5/2016 | Ahn | H01F 27/29 336/192 |

FOREIGN PATENT DOCUMENTS

JP 2011-243686 A 12/2011

* cited by examiner

*Primary Examiner* — Tuyen T Nguyen
(74) *Attorney, Agent, or Firm* — Oliff PLC

(57) ABSTRACT

At the position where the lead art of the wire is projecting out from the outer face of the core part and spaced apart from the side face, the bonding part between the lead part and the terminal electrode is formed. The terminal electrode comprises the terminal body installed along the side face of the core body, and the lead supporting part bended from the terminal body towards the bonding part at the near position where the lead part projects out from the side face of the core part. The crossing angle of the lead supporting part with respect to the side face of the core body is less than 90 degrees.

12 Claims, 9 Drawing Sheets

COIL DEVICE

BACKGROUND OF THE INVENTION

1. Field of the Invention

The present invention relates to a coil device comprising a core part including a coil part at the inside, and further specifically the present invention relates to a bonding structure between a terminal electrode and the lead part projecting out from the core part.

2. Description of the Related Art

As the coil device comprising the core part including the coil part at the inside, for example the coil device disclosed in Patent document 1 shown in below is known. As such type of coil device, at the position where the lead part projects out from the core part, the lead part projecting out from the core part is electrically connected to the terminal electrode installed at the outer face of the core part.

The positon of the lead part projecting out from the core part differs depending on the products, hence conventionally a pressure is applied to the lead part and the connecting part of the terminal electrode to temporarily fix using special device, then it is connected by a laser welding or so. As the structure of such conventional coil device, it is necessary to fix temporarily the lead part and the terminal electrode using the special device.

Patent document 1: JP Patent Application Laid Open No. 2011-243686

SUMMARY OF THE INVENTION

The present invention is attained in view of such situation, and the object of the present invention is to provide the coil device wherein the lead part and the terminal electrode can be easily positioned, and the reliability of the connecting part is improved.

In order to attain the above object, the coil device according to the first aspect of the present invention comprises a coil part having a wire wound around in a coil form, a core part having a magnetic material and a resin and covering entire said coil part including an inside of said coil part, and a terminal electrode installed at an outer face of said core part, wherein a lead part of said wire projects out from the outer face of said core part and a bonding part between said lead part and said terminal electrode is formed at a position spaced apart from said outer face, said terminal electrode comprises a terminal body installed along the outer face of said core body, and a lead supporting part bended from said terminal body towards said bonding part at the position near where said lead part projects out from the outer face of said core part, and a crossing angle θ1 of said lead supporting part with respect to an inner face of said terminal electrode is less than 90 degrees.

By setting the crossing angle θ1 within the predetermined range, even in case the position of the lead part projecting out from the outer face of the core part varies, the lead supporting part (or the lead part or both/the same applies hereinafter) resiliently deforms; thereby the tip part of the lead supporting part securely contacts with the lead part. Furthermore, because the lead supporting part is resiliently deformed, the lead part is temporarily fixed while positioned on the lead supporting part by being pressed with the resilient force.

Therefore, while the lead part is pressed to the tip part of the lead supporting part, these can be easily connected by a laser welding or so. Also, a stable connection can be attained, and the reliability of the connecting part can be improved. Also, the coil device according to the first aspect of the present invention does not need a special tool for temporary fixing.

The coil device according to the second aspect of the present invention comprises a coil part having a wire wound around in a coil form, a core part having a magnetic material and a resin and covering entire said coil part including an inside of said coil part, and a terminal electrode installed at an outer face of said core part, wherein a lead part of said wire projects out from the outer face of said core part and a bonding part between said lead part and said terminal electrode is formed at a position spaced apart from said outer face, said terminal electrode comprises a terminal body installed along the outer face of said core body, and a lead supporting part bended from said terminal body towards said bonding part at the position near where said lead part projects out from the outer face of said core part, and a crossing angle θ2 of said lead supporting part with respect to said lead part is less than 90 degrees.

The crossing angle θ2 is preferably 60 degrees or less, more preferably 1 to 50 degrees or less, and even more preferably 5 to 35 degrees.

By setting the crossing angle θ2 within the predetermined range, even in case the position of the lead part projecting out from the outer face of the core part varies, the lead supporting part resiliently deforms; thereby the tip part of the lead supporting part securely contacts with the lead part. Furthermore, because the lead supporting part is resiliently deformed, the lead part is positioned on the lead supporting part by being pressed with the resilient force.

Therefore, while the lead part is pressed to the tip part of the lead supporting part, these can be easily connected by a laser welding or so. Also, a stable connection can be attained, and the reliability of the connecting part can be improved. Note that, the method for forming the connecting part is as same as the first aspect. Also, the coil device according to the second aspect of the present invention does not need a special tool for temporary fixing.

An inclined face guiding said lead part on the tip part of said lead supporting part may be formed at a corner part of one side in a width direction of said lead supporting part from a middle of said lead supporting part to said bonding part. By having the inclined face, when installing the terminal electrode to the core part, the inclined face of the lead supporting part of the terminal electrode contacts from the side of the lead part exposed from the outer face of the core part. Therefore, the inclined face functions as the guiding part, and the lead part can be easily mounted on the lead supporting part, and the lead part and the lead supporting part of the terminal electrode can be easily positioned just by installing the terminal electrode to the core part.

At the tip part of said lead supporting part, a contact flat face which is substantially parallel to said lead part may be formed. Due to the resilience of the lead supporting part, the contact flat face which is substantially parallel to the lead part contacts with the lead part, thus these will press against each other by the resilient force, and the lead part is temporarily fixed by positioned in good condition on the contact flat face.

Said terminal body may comprise a main terminal body and a sub terminal body, and said lead supporting part may be formed integrally to said sub terminal body. By forming the lead supporting part to the sub terminal body, when the core part is installed to the main terminal body, the lead supporting part can be contacted from the side of the lead part, and the lead supporting part easily deforms resiliently, thereby the lead part can be temporarily fixed on the lead supporting part as the lead part is held resiliently.

At the outer face of said core part positioned at both sides of the coil axis direction of said coil part, the installation groove may be formed, and a resilience piece positioned at both sides of said coil axis direction of the main terminal body may be engaged with said installation groove. By constituting as such, the main terminal body can be easily installed to the core part.

At one side of said coil axis direction of said main terminal body, an installation piece installed at one side face of said coil axis direction of said core part may be formed integrally to said main terminal body. By constituting as such, when installing the main terminal body to the core part, the lead supporting part can be contacted from the side of the lead part. Therefore, the lead supporting part easily deforms resiliently, hence the lead part can be temporarily fixed on the lead supporting part by holding the lead part resiliently.

The production method of the coil device according to the present invention comprises a step of preparing the coil part having the wire wound around in a coil form, a step of exposing the lead part of the wire constituting said coil part from the outer face of the core part by covering the entire coil part including the inside of the coil part with the core part, and an installing step of the terminal electrode to the outer face of the core part, wherein said terminal electrode comprises a terminal body installed along the outer face of said core body, and a lead supporting part bended to the outer side in a crossing angle of θ1 from the inner face of said terminal body, when said terminal electrode is installed to the outer face of the core part, a tip part of the lead supporting part is contacted to the lead part which is projecting out from the outer face of the core part to resiliently deform said lead supporting part and/or said lead part, thereby temporarily fixing said lead part on the tip part of said lead supporting part so that these are pressing against each other, and then a bonding part of the lead part to the tip part of the lead supporting part is formed.

DESCRIPTION OF THE PREFERRED EMBODIMENTS

Hereinafter, the present invention will be described based on the embodiment shown in the figures.

First Embodiment

Figure 1:
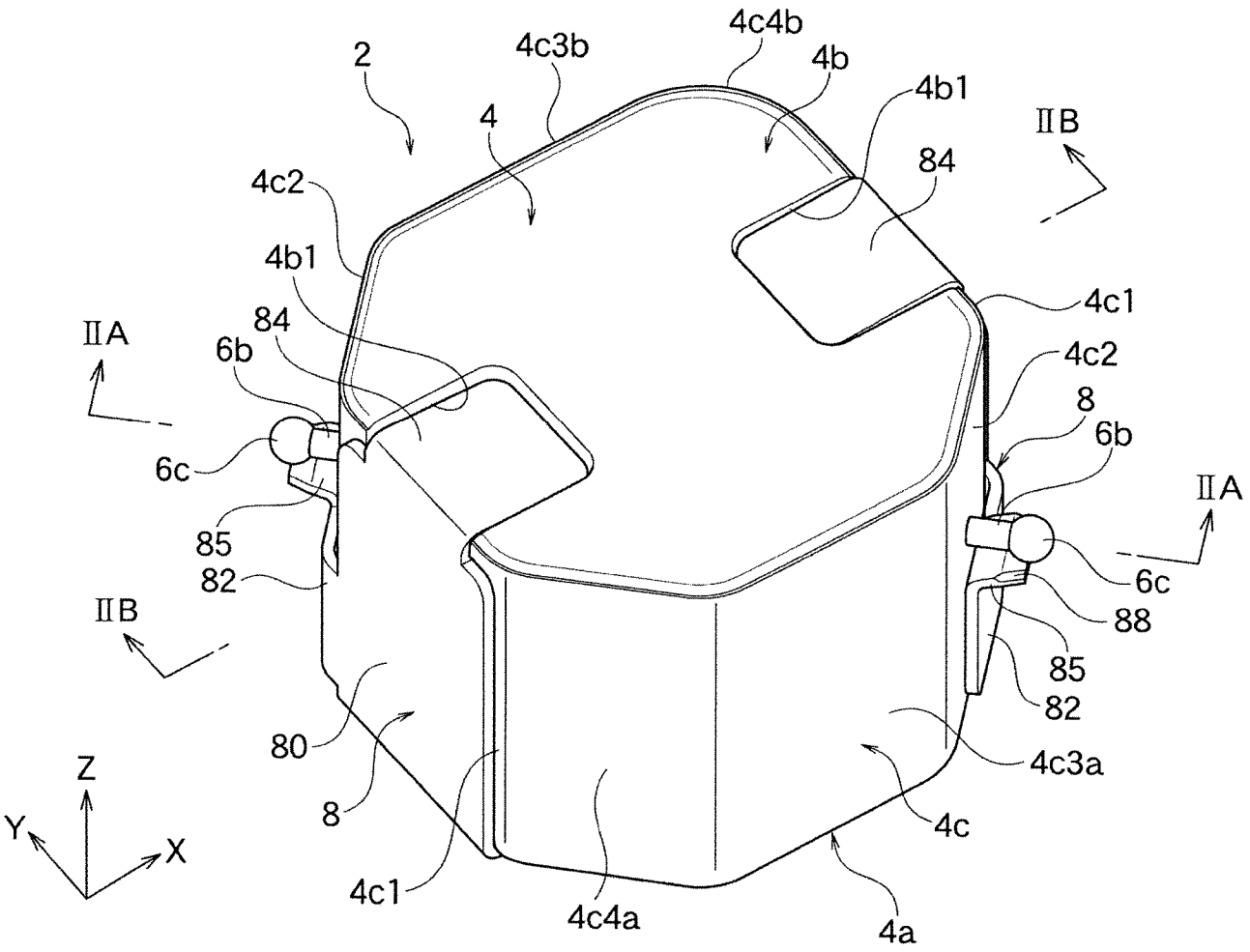
FIG. 1 is a perspective view of the coil device according to one embodiment of the present invention.
Figure 2A:
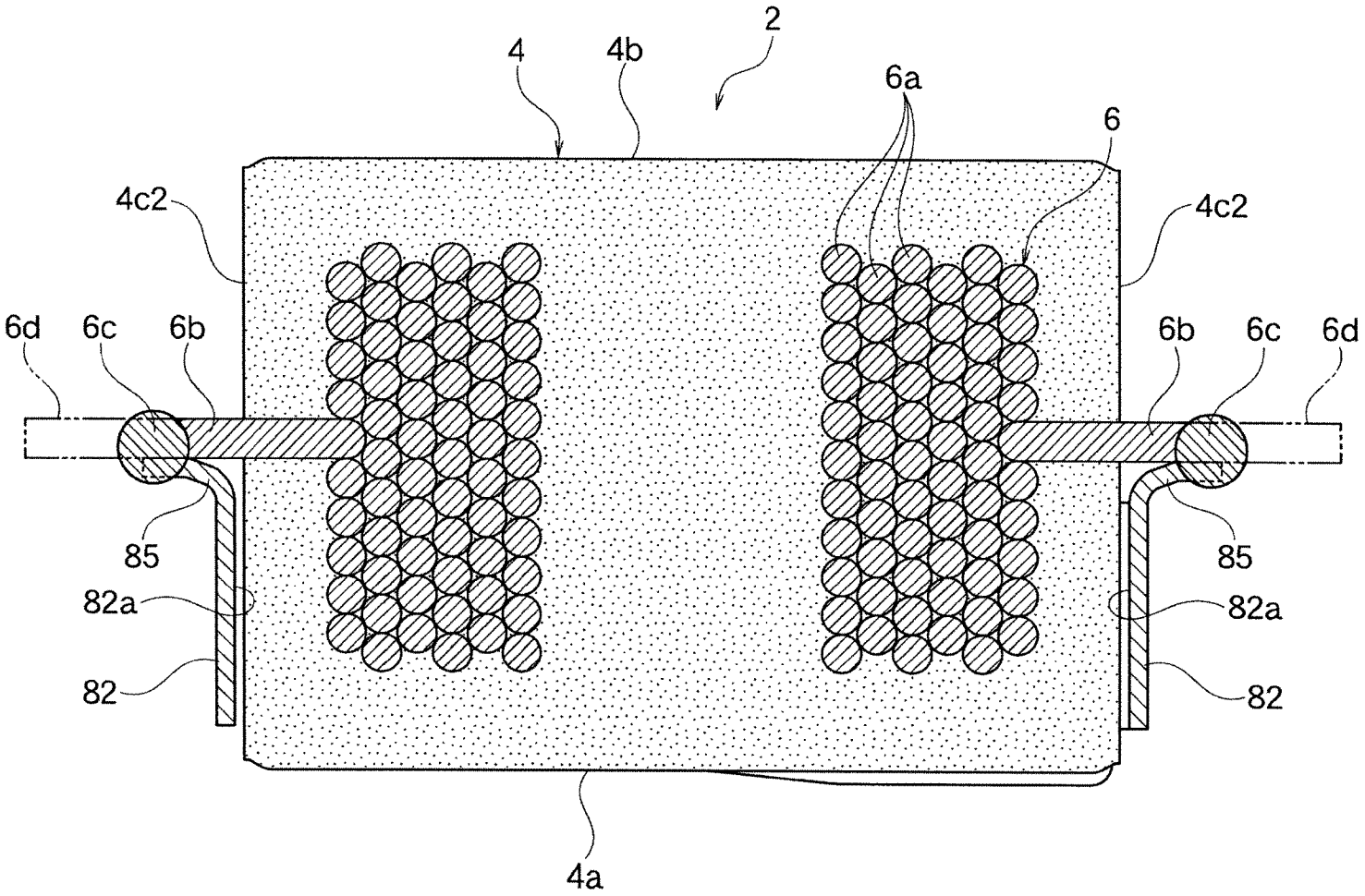
FIG. 2A is a cross section of the coil device shown in FIG. 1 along IIA-IIA line.
Figure 2B:
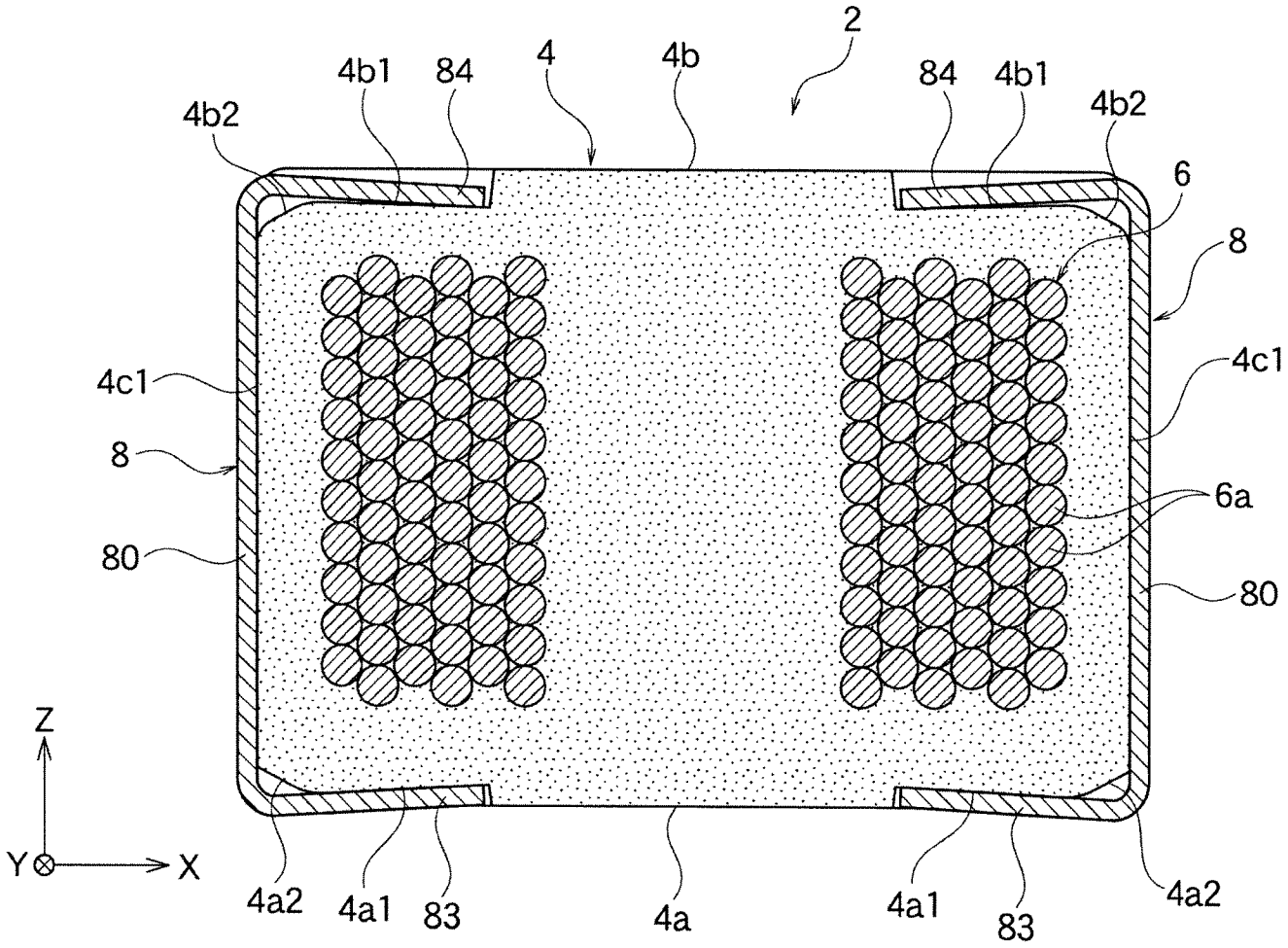
FIG. 2B is a cross section of the coil device shown in FIG. 1 along IIB-IIA line.

As shown in FIG. 1, FIG. 2A and FIG. 2B, the inductor element 2 as the coil device of the first embodiment of the present invention comprises the core part 4 as the compressed molded article, the coil part 6 having a wire 6*a* wound around in a coil form at the inside of the core part 4, and the terminal electrode 8 connected to lead part 6*b* of the wire 6*a* by the bonding part 6*c*. For the present embodiment, in the figure, the coil axis direction of the coil part 6 is Z axis, and the axes perpendicular to this is X axis and Y axis respectively. In the present embodiment, X axis matches with the direction of a pair of electrodes 8 facing each other, but it is not particularly limited thereto.

The wire 6*a* is for example constituted by a conductive wire, and if necessary, an insulating coating layer which covers the outer peripheral of the conductive wire. The conductive wire is for example constituted by Cu, Al, Fe, Ag, Au and phosphor bronze or so. The insulation coating layer is constituted for example by polyurethane, polyimide-imide, polyimide, polyester, polyester-imide, polyester-nylon or so. The transverse cross section shape of the wire 6*a* is not particularly limited, and for example circular shape and a straight angle shape or so may be mentioned.

The core part 4 is formed by carrying out a compression molding or an injection molding to the powder including the magnetic powder and the binder. The magnetic powder is not particularly limited, and for example the metal magnetic powders such as sendust (Fe—Si—Al; iron-silicon aluminum), Fe—Si—Cr (iron-silicon-chromium), permalloy (Fe—Ni), carbonyl iron based, carbonyl Ni based, amorphous powder, nanocrystal powder or so may be used preferably.

Note that, the magnetic powder may be ferrite magnetic powder such as Mn—Zn, Ni—Cu—Zn or so. As the binder, it is not particularly limited, however for example epoxy resin, phenol resin, acrylic resin, polyester resin, polyimide, polyamide-imide, silicon resin, and the combination thereof may be mentioned.

The core part 4 is formed with the mounting side outer face 4*a* at the lower part in Z axis direction, and also formed with the mounting side opposite outer face 4*b* at the upper part in Z axis direction. The side face 4*c* which is the outer face on the side is formed between the mounting side outer face 4*a* and the mounting side opposite outer face 4*b*.

In the present embodiment, the side face 4*c* is constituted from the combination of plurality of flat faces and curved face, but it is not limited thereto, and it may be a curved face as a whole, or it may have side face of polygonal shape as a whole. In the present embodiment, when the core part 4 is viewed from the upper part or the lower part of Z axis direction, it is preferably asymmetrical. This is because, when the core part 4 is viewed from the upper part or lower part of Z axis direction, the shape or the direction of the coil device can be easily recognized.

Figure 5A:
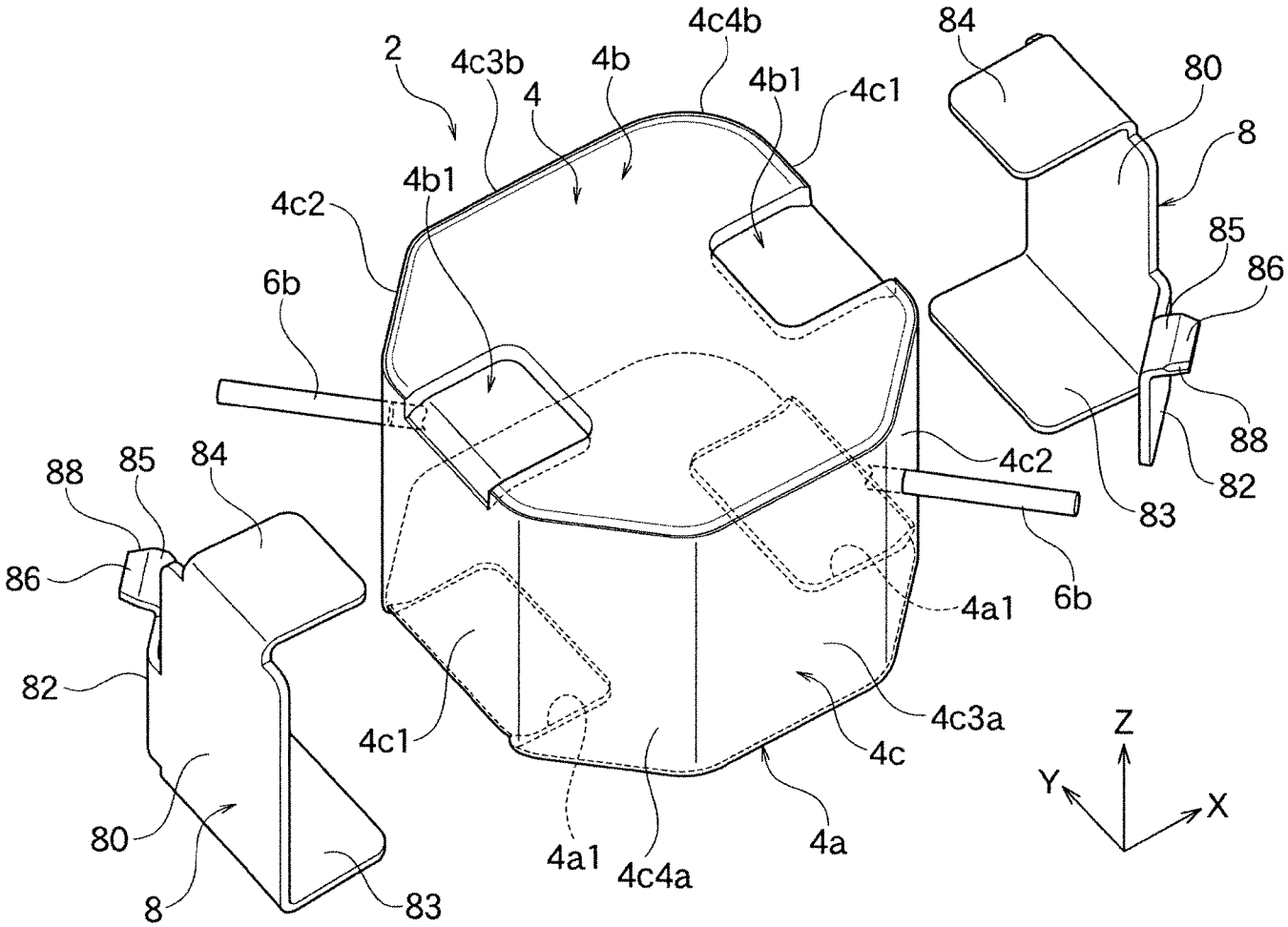
FIG. 5A is an explosive perspective view before installing the terminal to the core part shown in FIG. 4.

As shown in FIG. 5A, the side face 4*c* of the core part 4 comprises a pair of main installation side face 4*c*1 positioned at the opposite side against each other in X axis direction. In the present embodiment, the main installation side face 4*c*1 is formed in a flat face form which is in accordance with the shape of the main terminal body 80 of the terminal electrode 8; but if the inner face of the main terminal body 80 has a curved form, then the main installation side face 4*c*1 may have curved form as well. Also, the side face 4*c* of the core part 4 comprises the sub installation side face 4*c*2 adjacent in clockwise direction of the main installation side face 4*c*1 viewing from the upper part in Z axis direction. The lead part 6*b* is projecting out from the sub installation side face 4*c*2.

Further, the side face 4*c* of the core part 4 comprises non-installation side faces 4*c*3*a*, 4*c*4*a*, or 4*c*3*b*, 4*c*4*b* next to the sub installation side face 4*c*2 in clockwise direction viewing from the upper part in Z axis direction. The present embodiment comprises the side faces 4*c*1 and 4*c*1 positioned at the opposite of each other having the same shape and area respectively; and the same applies to the side faces 4*c*2 and 4*c*2.

However, the non-installation side faces 4*c*3*a* and 4*c*3*b* which are positioned opposite of each other comprises the different width in X axis direction against each other. Also, for the non-installation side faces 4*c*4*a* and 4*c*4*b* positioned at the opposite of each other, one is flat face and the other has the curved face; and has a different shape against each other. That is, in the present embodiment, the non-installation side faces 4*c*3*a* and 4*c*3*b* (4*c*4*a* and 4*c*4*b*) positioned at the opposite of each other have different shape and size respectively. By constituting as such, the core part 4 can have asymmetrical shape when viewed from the upper part or lower part of Z axis direction.

As shown in FIG. 2A and FIG. 2B, the coil part 6 is a part where one or more of the wire 6*a* is wound around in coil form; and at least a pair of lead part 6*b* which is the both ends of the wire 6*a* is pulled out from the coil part 6 to the outside of the core part 4. In the embodiment shown in the figure, a pair of the lead part 6*b* is pulled out from the sub installation side face 4*c*2 of the core part 4 to the outside in approximately perpendicular direction with respect to said side face.

In the present embodiment, as shown in FIG. 5A, each terminal electrode 8 comprises the main terminal body 80. The main terminal body 80 has a flat plate shape of square form in accordance with the shape of the main installation side face 4*c*1 of the core body 4; however as already discussed in above, if the shape of the main installation side face 4*c*1 changes, then it may have the shape in accordance with the main installation side face 4*c*1.

The lower resilience piece 83 is formed integrally by bending from the main terminal body 80 at the lower part of Z axis direction of the main terminal body 80. Also, the upper resilience piece 84 is integrally formed by bending the main terminal body 80 at the upper part of Z axis direction of the main terminal body 80. The lower resilience part 83 is formed so that it engages with the lower installation groove 4*a*1 formed at the mounting side outer face 4*a* which is the bottom face of the core part 4.

As shown in FIG. 2B, the bottom part of the lower installation groove 4*a*1 is inclined to the upper direction of Z axis direction towards the center axis of the coil part 6, so that when the lower resilience piece 83 is engaged with the lower installation groove 4*a*1, it becomes difficult to disengage. Also, at the crossing corner part between the lower installation groove 4*a*1 and the sub installation side face 4*c*1, a lower chamfer part 4*a*2 having a flat face form or a curved form is provided. When installing the terminal electrode 8 to the core part 4, the tip part of the resilience piece 83 contacts with the chamfer part 4*a*2, and from there, the resilience piece 83 is pressed against the resilient force along the inclination of the chamfer part 4*a*2, thereby it is easily guided to the lower installation groove 4*a*1.

As shown in FIG. 2B, the upper resilience piece 84 is formed so that it engages with the mounting side opposite outer face 4*b* which is the upper face of the core part 4. The bottom part of the upper installation groove 4*b*1 is inclined to lower direction in Z axis direction towards the center axis of the coil part 6, and when the upper resilience piece 84 is engaged with the upper installation groove 4*b*1, it becomes difficult to disengage. Also, at the crossing corner part between the upper installation groove 4*b*1 and the sub installation side face 4*c*1, the upper chamfer part 4*b*2 having the flat face form or curved form is provided. When installing the terminal electrode 8 to the core part 4, the tip part of the resilience piece 84 contacts with the chamfer part 4*b*2, and from there, the resilience piece 84 is pressed against the resilient force along the inclination of the chamfer part 4*b*2, thereby it is easily guided to the upper installation groove 4*b*1.

Figure 5B:
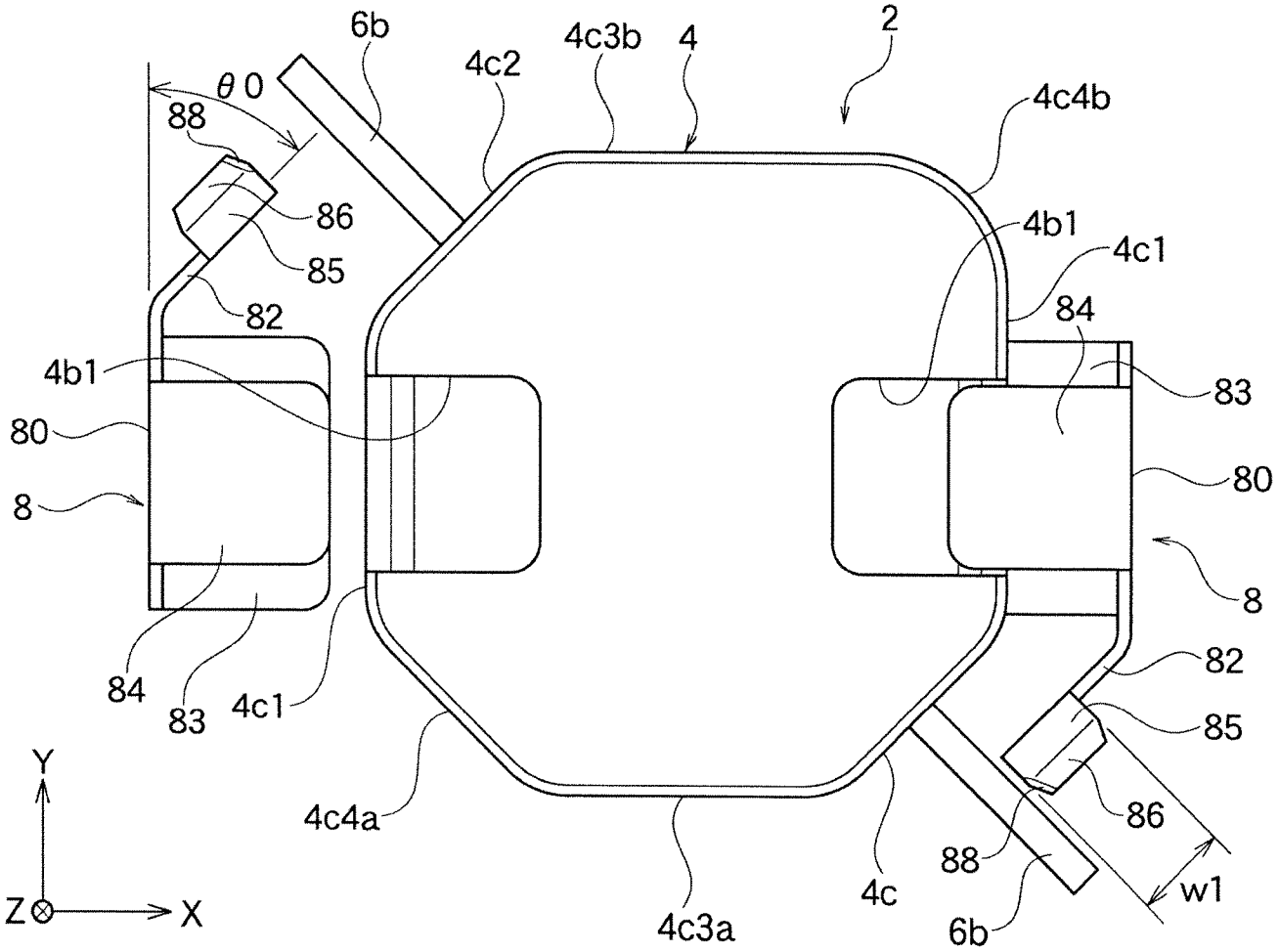
FIG. 5B is an explosive planar view showing the condition before installing the terminal to the core part shown in FIG. 5A.

As shown in FIG. 5A, the sub terminal body 82 is integrally formed to the main terminal body 80. As shown in FIG. 5B, the sub terminal body 82 is bended so that it crosses at the angle of θ0 with respect to the face of the main terminal body 80. The angle of θ0 roughly matches with the crossing angle between the main installation face 4*c*1 and the sub installation face 4*c*2 of the core part 4. By appropriately regulating this angle, the tip part of the lead supporting part 85 which will be discussed in below is easily guided to the lower part of the lead part 6*b* while being contacted by pressure.

The sub terminal body 82 has the shape of the inner face in accordance with the shape of the outer face of the sub installation face 4*c*2, and in the present embodiment, it is flat plate shape; but it may be a curved shape in accordance with the shape of the outer face of the sub installation face 4*c*2. As shown in FIG. 2A, the sub terminal body 82 faces with the outer face of the sub installation face 4*c*2, and it does not necessarily have to be in contact. Rather, the inner face 82*a* of the sub terminal body 82 and the sub installation face 4*c*2 may be intentionally spaced apart. This is to enhance the resilience of the sub terminal body 82 and the lead supporting part 85 integrally formed thereon.

The sub terminal body 82 is smaller than the height of the main terminal body 80 in Z axis direction, and has smaller height than the height from the mounting side outer face 4*a* of the core part 4 to the position where the lead part 6*b* projects out. At the upper part in Z axis direction of the sub terminal body 82, as shown in FIG. 5A, the lead supporting part 85 is integrally formed by bending to the outside from the sub terminal body 82. Note that, the outside of the terminal electrode 8 refers to the side away from the core part 4, and the inner side refers to the side approaching to the core part 4.

Figure 3A:
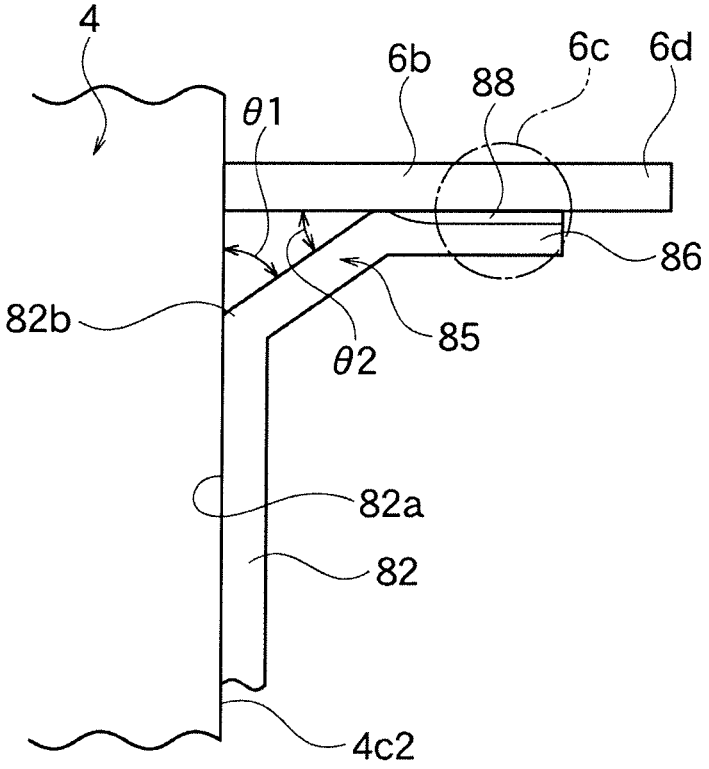
FIG. 3A is a schematic view of the essential part showing the condition of the connecting part before connecting the terminal and the lead part shown in FIG. 2A.

As shown in FIG. 3A, the crossing angle θ1 formed by bending the lead supporting part 85 to the outside of the inner face 82*a* of the sub terminal body 82 is smaller than 90 degrees, and preferably 55 to 85 degrees, and more preferably 65 to 75 degrees. Note that, at the crossing part 82*b* between the inner face 82*a* of the sub terminal body 82 and the upper face of the lead supporting part 85, a curved face may be formed for bending. A radius of curvature of the curved face is preferably 0.05 to 0.25 mm.

In the present embodiment, at the tip part of the lead supporting part 85, a contact flat face 86 which is substantially parallel to the lead part 6*b* may be formed. Due to the resilience of the lead supporting part 85, the contact flat face 86 which is substantially parallel to the lead part 6*b* contacts with the lead part 6*b*, thereby presses against each other by resilient force, and the lead part 6*b* is temporarily fixed by being positioned in good condition on the contact flat face 86.

The contact flat face 86 is formed integrally by bending from the lead supporting part 85, and has same thickness as the lead supporting part 85, but the tip side may be formed thinner. Also, in the present embodiment, as shown in FIG. 5B, the contact flat face 86 may have narrower width w1 towards the tip side. The width w1 of the contact flat face 86 is determined based on the relation between the outer diameter ϕ of the wire 6*a* (the lead part 6*b*), and W1/ϕ is preferably 1 to 10. The outer diameter ϕ of the wire 6*a* is not particularly limited, and preferably 0.03 to 1.5 mm. Also, the thickness of the terminal electrode 8 is not particularly limited, but preferably it is 0.08 to 0.25 mm.

For the tip part of the lead supporting part 85, in the present embodiment, at the corner part of one side (it may be both sides) of the width direction of the contact flat face 86, the inclined face 88 guiding the lead part 6*b* on the contact flat face 86 which is the tip part of the lead supporting part 85 may be formed. The inclined face 88 can be for example formed by a chamfer processing or so. As shown in FIG. 5B, the inclined face 88 of flat face form or curved form is formed at the corner part between the upper face of Z axis direction of the contact flat face 86 and the tip face of projecting direction of the sub terminal body 82.

Therefore, when installing the terminal electrode 8 to the core part 4, the inclined face 88 of the lead supporting part 85 of the terminal electrode 8 contacts from the side of the lead part 6*b* exposed from the outside face of the core part 4. Thus, the inclined face 88 functions as the guiding part, and the lead part 6*b* can be easily mounted on the lead supporting group 85. The lead supporting part 85 of the terminal electrode 8 and the lead part 6*b* can be easily positioned just by installing the main terminal body 80 of the terminal electrode 8 to the core part 4 from the both sides of X axis direction.

Figure 3B:
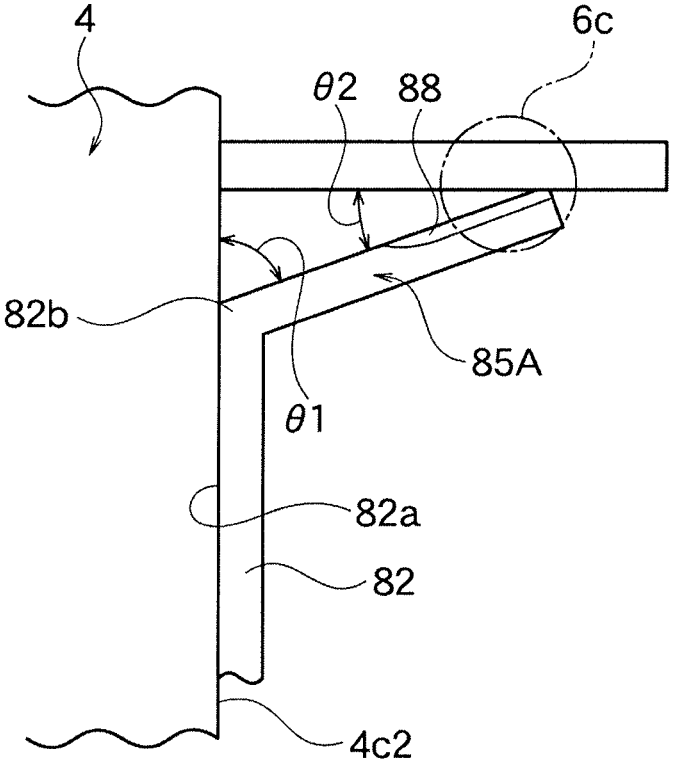
FIG. 3B is a schematic view of the essential part according to other example of the condition of the connecting part before connecting the terminal and the lead part shown in FIG. 2A.

Note that, as shown in FIG. 3B, at the tip part of the lead supporting part 85, the entire lead supporting part 85A may be formed to have a flat plate form continuous to the tip part without forming the contact flat face 86 shown in FIG. 3A. In such case, the inclined face 88 may be continuously formed from the middle of the lead supporting part 85 to the tip. In any case, the crossing angle θ1 will be a similar angle.

Figure 4:
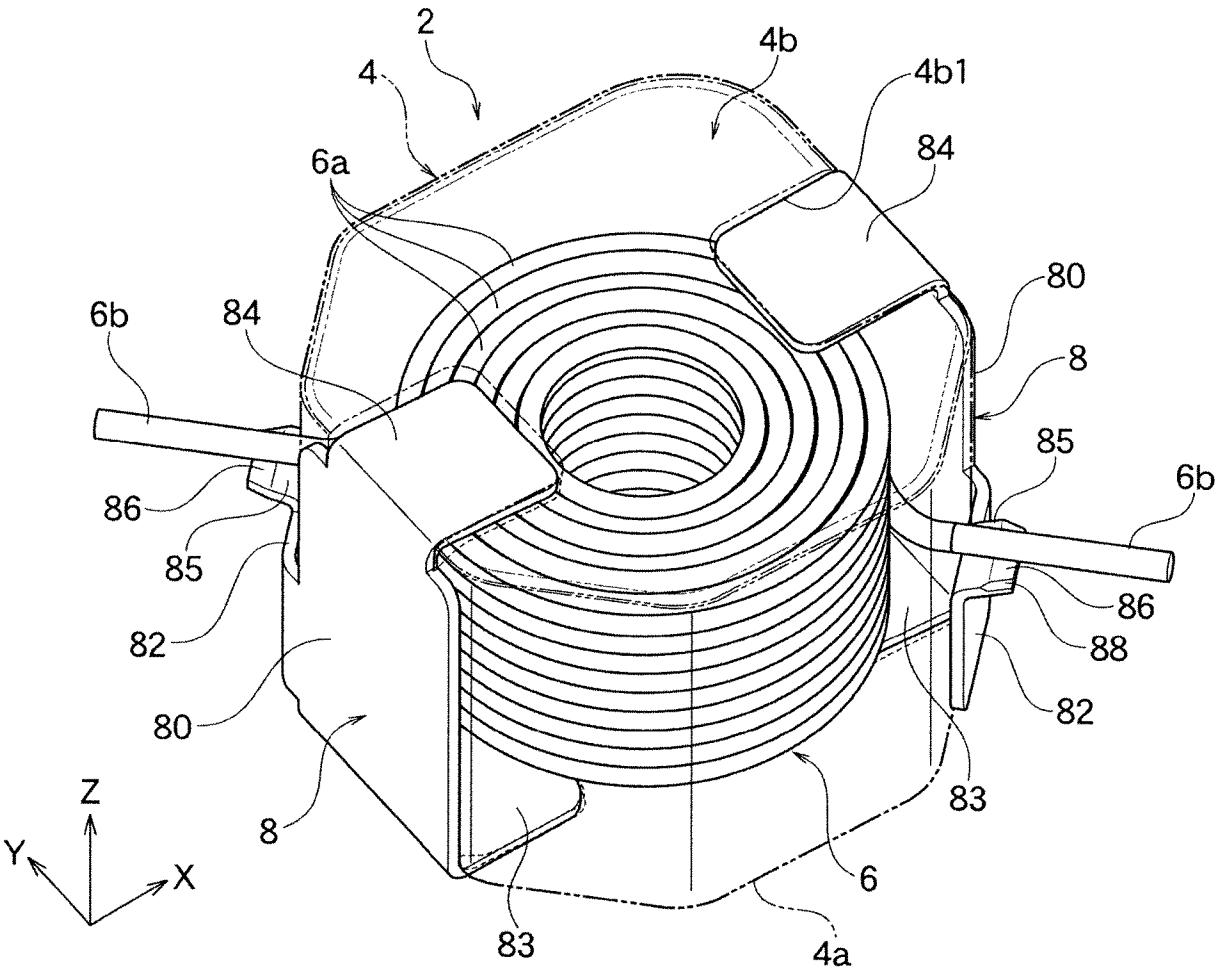
FIG. 4 is a perspective projection view of the core part showing the condition before connecting the terminal and the lead part shown in FIG. 3A.

Next, the production method of the inductor element 2 shown in FIG. 1 to FIG. 5B will be described. First, as shown in FIG. 2A, FIG. 2B and FIG. 4, the coil part 6 having the wire 6*a* wound around in coil form is prepared. The coil part 6 is constituted by an air core coil.

Next, the entire coil part 6 including the inside of the coil part 6 is covered with the core part 4, and the lead part 6*b* of the wire 6*a* constituting the coil part 6 is exposed from the outer face of the core part 4. The core part 4 is molded for example by inserting the coil part 6 in the cavity of the mold, and filling the cavity with the mixture including the magnetic powder and the binder resin, then compressing the whole thing, thereby the inductor element 2 shown in FIG. 1 and FIG. 2A is obtained.

As the method of compression molding, the metal mold may be used, and oil pressure or water pressure or so may be used. After the molding, the lead part 6*b* is taken out together with the molded article.

In the present embodiment, the magnetic powder is the metal magnetic powder, and the outer peripheral of the particle thereof is preferably coated by an insulation coating. As the insulation coating, a metal oxide coating, and resin coating or so may be mentioned. The particle diameter of the magnetic powder is preferably 0.5 to 50 μm. Also, at the outer surface of the obtained core part, a glass coating or an insulation resin coating or so may be carried out.

At the same time of the molding of the core part 4, or before or after the molding of the core part 4, the terminal electrode 8 is prepared in the present embodiment. The terminal electrode 8 is preferably constituted by metals (including alloy) such as Cu and phosphor bronze or so. The terminal electrode 8 is obtained by punching out and bending the single metal plate having even thickness or the composite metal plate such as clad material or so. At the surface of the terminal electrode 8, a plating film may be formed in order to improve the adhesiveness between the solder or so. At the terminal electrode 8, the main terminal body 80, the sub terminal body 82 and the lead supporting part 85 are formed. Also, at the terminal electrode 8, if needed, the lower resilience piece 83, the upper resilience piece 84, the contact flat face 86 and the inclined face 88 may be formed.

When installing the terminal electrode 8 to the outer face of the core part 4, the tip part of the lead supporting part 85 is contacted from the side of the lead part 6*b* to the lead part 6*b* which is projecting out from the outer face of the core part 4, and the lead supporting part 85 and/or the lead part 6*b* are deformed resiliently. As a result, the lead part 6*b* can be temporarily fixed on the tip part of the lead supporting part 85 so that these are pressing against each other.

In the present embodiment, there is no need of the adhesive agent for fitting the resilience pieces 83 and 84 respectively to the installation grooves 4*a*1 and 4*b*1, however the terminal electrode 8 may be fixed to the outer face of the core part 4 using the adhesive agent.

Then, the bonding part 6*e* between the lead part 6*b* is formed at the tip part of the lead supporting part 85. Before forming the bonding part 6*c*, the resin coating of the resin part 6*b* is preferably removed. Further preferably, the resin coating of the lead part 6*b* is removed before installing the terminal electrode 8 to the outer face of the core part 4.

The extra tip part 6*d* of the lead part 6*b* remaining after forming the bonding part 6*c* is removed at the same time of the laser irradiation. Alternatively, it may be removed after the laser irradiation. Alternatively, it may be removed before the laser irradiation. At the bonding part 6*c*, the lead part 6*b* and the tip part of the lead supporting part 85 are bonded for example by a laser welding. Note that, as the method for forming the connecting part 6*c*, it is not limited to a laser welding, and an arc welding, an ultrasonic bonding, and a thermal compression bonding or so may be mentioned.

Even after the bonding part 6*c* is formed, the crossing angle θ1 barely, changes prior to the forming of the bonding part 6*c*. Even if it more or less changes, it is within the preferable range of angle as discussed in above. Also, the crossing angle θ1 after the terminal electrode 8 is installed to the core part 4 may slightly change compare to before the installation, but even if it slightly changes, it is within the preferable range of angle as discussed in above. Also, even when the bonding part 6*e* is formed, a part of the inclined face 88 remains.

In the present embodiment, by having the crossing angle θ1 shown in FIG. 3A and FIG. 3B within the range of predetermined angle, even if the positon in Z axis direction of the lead part 6*b* projecting out from the sub installation side face 4*c*2 which is the outer face of the core part 4 slightly varies, this will not be a problem. That is, the lead supporting part 85 (including the contact flat face 86/hereinafter the same applies), or the lead part 6*b* or the both resiliently modifies, thereby the tip part of the lead supporting part 85 securely contacts with the lead part 6*b*. Further, because the lead supporting part 85 is deformed resiliently, the lead part 6*b* is temporarily fixed and positioned on the tip part of the lead supporting part 85 by being pressed by resilient force.

Also, even if the position in circumference direction of the lead part 6*b* projecting out from the sub installation side face 4*c*2 which is the outer face of the core part 4 slightly varies, this will not be a problem. That is, as shown in FIG. 5B, the width w1 of the lead supporting part 85 is sufficiently large compared to the outer diameter of the lead part 6*b*, thus above mentioned variation is securely absorbed, and the lead part 6*b* is temporarily fixed and positioned on the tip part of the lead supporting part 85 by being pressed by resilient force.

Therefore, while the lead part 6*b* is pressed against the tip part of the lead supporting part 85, these can be easily connected by a laser welding or so, and as shown in FIG. 3A and FIG. 3B, the connecting part 6*c* with the lead supporting part 85 can be easily formed to the tip of the lead part 6*b*. Also, the stable connection can be carried out, and the reliability of the connecting part 6*c* improves. Particularly, when carrying out a laser welding, the terminal electrode 8 and the lead part 6*b* are preferably securely contacted. However according to the present embodiment, these can be securely contacted, thus the instability of the bonding part is prevented, and the quality of the bonding can be improved.

Also, the coil device 2 according to the present embodiment does not need a special tool for temporary fixing. That is, as shown in FIG. 5B, just by installing the main terminal body 80 of the terminal electrode 8 to the core part 4 from the both sides in X axis direction, the inclined face 88 (the tip part in width direction of the lead supporting part 85) of the lead supporting part 85 of the terminal electrode 8 contacts from the side of the lead part 6*b* exposing from the outeside face of the core part 4, Therefore, the inclined face 88 functions as the guiding part, and the lead supporting part 85 is pressed down by the resilient force, thereby the lead part 6*b* is mounted on the lead supporting part 85, and these are temporarily fixed by being pressed by resilient force.

Note that, the lead supporting part 85 is contacted from the side with respect to the lead part 6, thereby pressed down by the resilient force and the lead part 6 may be resiliently deformed to some extent. Note that, the thickness of the plate and the material of the terminal electrode 8 is suitably selected so that the resilient deformation of the lead supporting part 85 is larger than the lead part 6.

Also, in the present embodiment, the tip part of the lead supporting part 85 is formed with the contact flat face 86 which is substantially parallel with the lead part 6*b*. In this case, due to the resilience of the lead supporting part 85, the contact flat face 86 which is substantially parallel to the lead part 6*b* contacts with the lead part 6*b*, thereby these press against each other by resilient force, and the lead part 6*b* is temporarily fixed by being positioned in good condition on the contact flat face 86.

Further, in the present embodiment, the terminal body comprises the main terminal body 80 and the sub terminal body 82, and the sub terminal body 82 is formed integrally with the lead supporting part 85. By forming the lead supporting part 85 to the sub terminal body 82, when installing the main terminal body 80 to the core part 4, the lead supporting part 85 can be contacted from the side of the lead part 6*b*, thus the lead supporting part 85 easily deforms resiliently, thereby the lead part 6*b* can be temporarily fixed on the lead supporting part 85 by holding resiliently.

The size of the inductor element 2 of the present embodiment is not particularly limited, and for example, the width X0 in X axis direction is 1.0 to 20 mm, the width Y0 in Y axis direction is 1.0 to 20 mm, and the height Z0 is 1.0 to 10 mm.

Second Embodiment

The inductor element according to the present embodiment is as same as the inductor element 2 of the first embodiment except for as described in below, and the overlapping description will be omitted, As shown in FIG. 3A and FIG. 3B, in the present embodiment, the crossing angle θ2 of the lead supporting part 85 with respect to the lead part 6*b* is less than 90 degrees. The crossing angle θ2 is preferably 60 degrees or less, and more preferably 1 to 50 degrees, and even more preferably 5 to 35 degrees.

Note that, even after the bonding part 6*c* is formed, the crossing angle θ2 barely changes prior to the forming of the bonding part 6*c*. Even if it changes more or less, it is within the preferable range. Also, the crossing angle θ2 of after installing the terminal electrode 8 to the core part 4 may slightly change compared to before the installation, however even if it slightly changes, it is within the preferable range discussed in above. Also, even if the bonding part 6*c* is formed, a part of the inclined face 88 remains.

In the aforementioned first embodiment, from the coil part 6, a pair of the lead part 6*b* is pulled out from the sub installation face 4*c*2 of the core part 4 to the outside in approximately perpendicular direction with respect to the side face, however the direction of pulling out the lead part 6*b* does not necessarily have to be in approximately perpendicular direction from the sub installation side face 4*c*2 of the core part 4. In such case, the crossing angle θ1 shown in FIG. 3A and FIG. 3B may not fall within the preferable range of the crossing angle θ1 according to the present first embodiment. However, in such case, if the crossing angle θ2 falls within the preferable range of the crossing angle θ2 according to the present embodiment, then the same effect as the first embodiment can be obtained.

Third Embodiment

Figure 6:
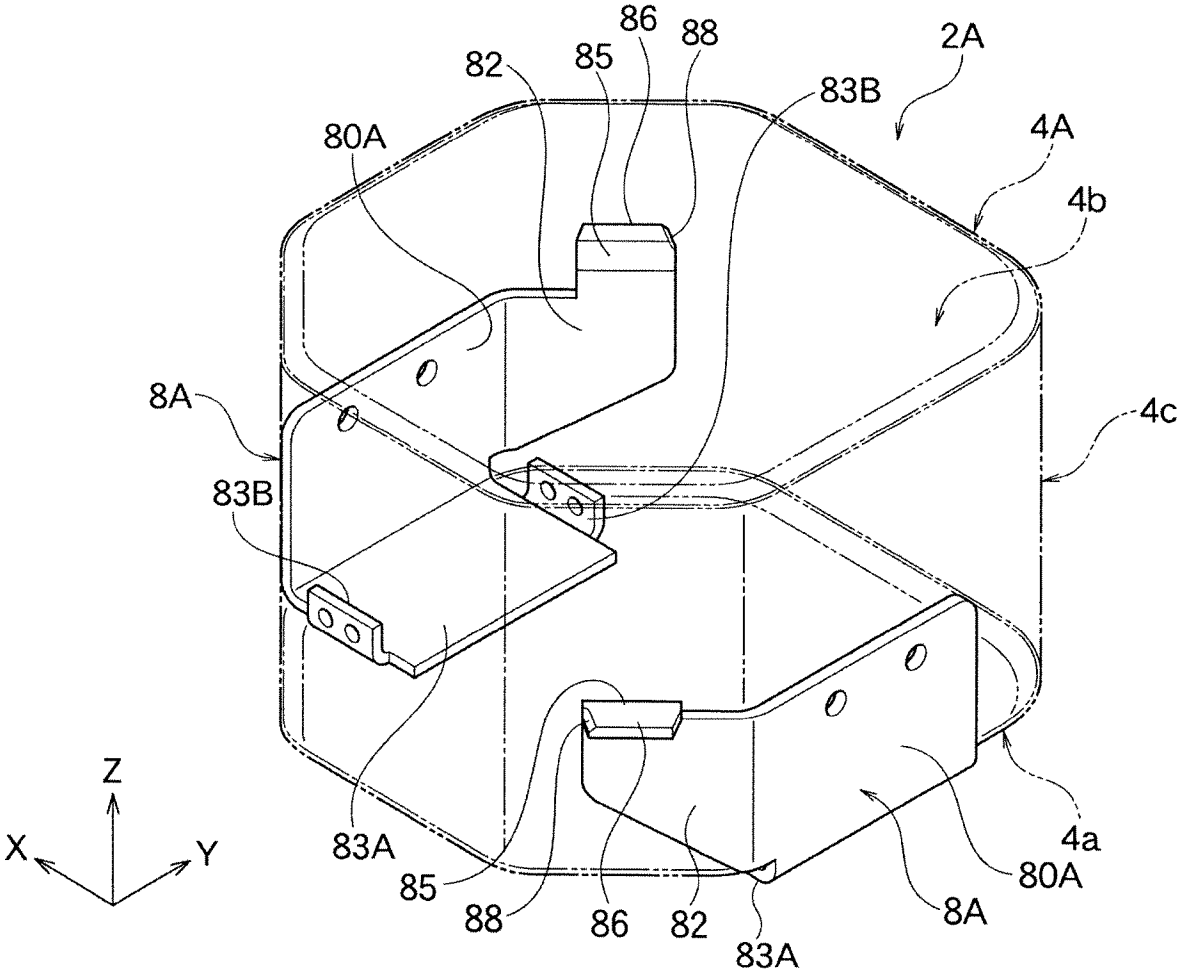
FIG. 6 is a perspective view of the coil device according to other embodiment of the present invention, but the coil part and the lead part are not shown in the figure.

The inductor element according to the present embodiment is the same as the inductor element 2 of the first embodiment or the second embodiment except for as described in below, and the overlapping description will be omitted. As shown in FIG. 6, in the inductor element 2A according to the present embodiment, the terminal electrode 8A comprises the main terminal body 80A and the sub terminal body 82. The constitution of the sub terminal body 82 is same as the aforementioned embodiment.

The main terminal body 80A is different from the main terminal body 80 of the aforementioned embodiment, and it does not comprise the upper resilience piece 84, further the height in Z axis direction is about half or less of the main terminal body 80. At the lower part in Z axis direction of the main terminal body 80A, the lower installation piece 83A is formed integrally by bending from the main terminal body 80A. At the lower installation piece 83A, the embedded projection part 83*b* is formed integrally by bending. When molding the core part 4*a*, the terminal electrode 8A is insert molded, thereby the embedded projection part 83*b* is embedded in the inside of the mounting side outer face 4*a* of the core part 4A.

Note that, the terminal electrode 8A may be installed to the outer face of the core part 4A by adhesive agent without forming the embedded projection part 83*b*. In the present embodiment, the same effect as the first embodiment and the second embodiment can be obtained.

Fourth Embodiment

Figure 7:
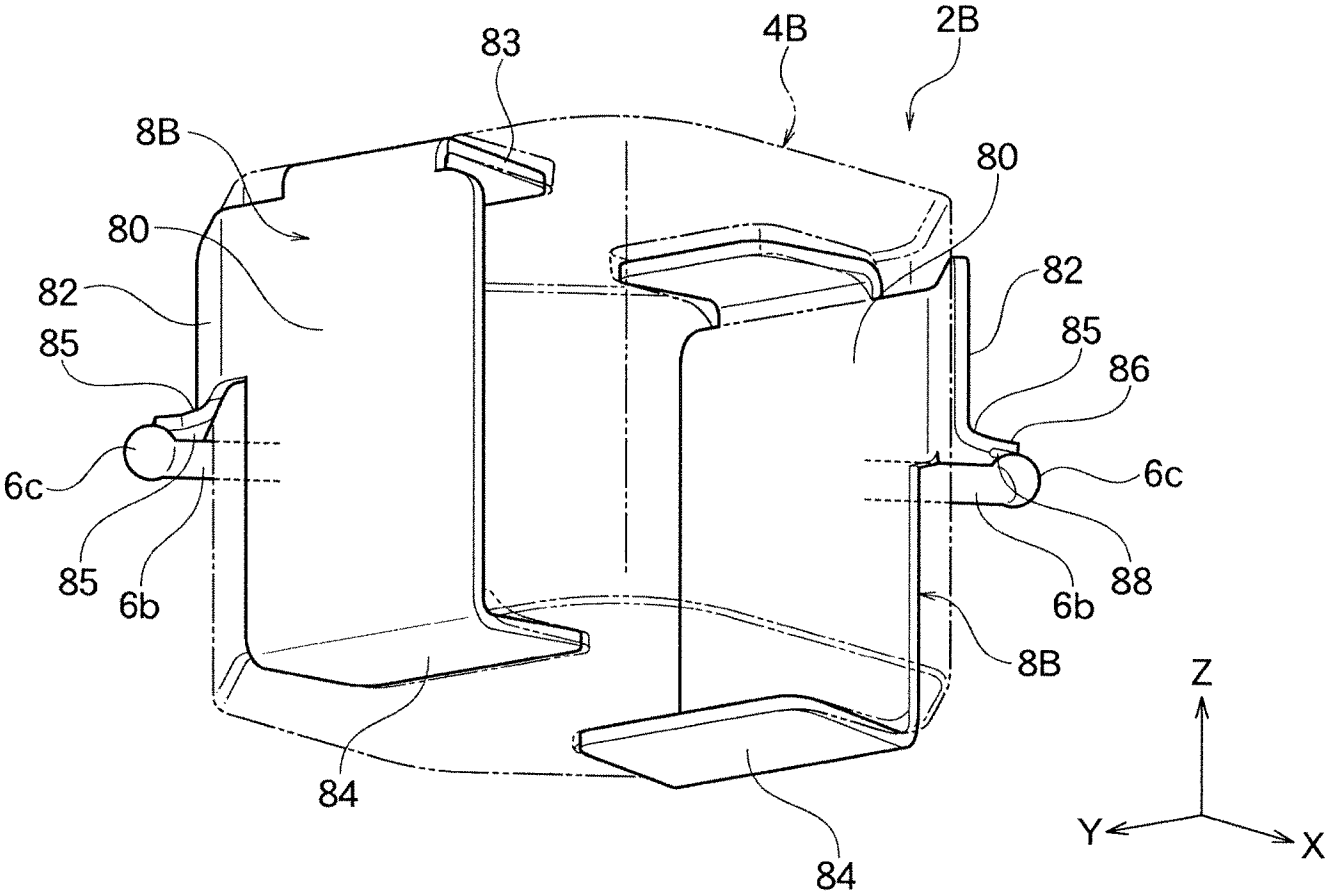
FIG. 7 is a perspective view of the coil device according to other embodiment of the present invention, but the coil device is not shown in the figure.

The inductor element according to the present embodiment is the same as the inductor element 2 of the first and second embodiments except for as described in the following, and the overlapping description will be omitted. As shown in FIG. 7, the inductor element 2B according to the present embodiment has reversed constitution wherein the Z axis direction of the inductor element 2 shown in FIG. 1 to FIG. 5 is upside down; that is the mounting face to the circuit substrate is reversed in upside down.

Also, when comparing the inductor element 2 with the upside down inductor element 2B, the position of the main terminal body 80 and the sub terminal body 82 are reversed in left-to-right looking from X axis direction with respect to the position of these in the inductor element 2. In the present embodiment, the same effect as the first embodiment and the second embodiment can be obtained.

Note that, the present invention is not to be limited to the aforementioned embodiments, and it may be modified within the scope of the present invention.

For example, the side faces 4*c*1 and 4*c*1 positioned opposite against each other as shown in FIG. 1 have the same shape and area, however these may be different. The same applies to the side faces 4*c*2 and 4*c*2.

Also, in the above mentioned embodiment, the coil part 6 has a circular coil form, but it is not particularly limited thereto, and it may be a square coil form, a polygonal coil form, an oval coil form, and other coil form. Further, the shape of the core part 4 and 4A is not particularly limited, and it may be a circular column form, an oval column form, and a polygonal column form.

The coil device according to the present invention can be used as the transformer for electric power, an inductor for electric power, and an inductor for noise removal or so used for an electronic component, an electric device and automobile device.

NUMERICAL REFERENCES

2, 2A . . . Inductor element (Coil device)
4 . . . Core part
4*a* . . . Mounting side outer face
4*a*1, 4*b*1 . . . Installation groove
4*a*2, 4*b*2 . . . Chamfer part
4*b* . . . Mounting side opposite outer face
4*c* . . . Side face (outer side face)
4*c*1 . . . Main installation side face
4*c*2 . . . Sub installation side face
4*c*3*a*, 4*c*3*b*, 4*c*4*a*, 4*c*4*b* . . . Non-installation side face
6 . . . Coil part
6*a* . . . Wire
6*b* . . . Lead part
6*c* . . . Bonding part
8 . . . Terminal electrode
80 . . . Main terminal body
82 . . . Sub terminal body
83, 84 . . . resilience piece
85 . . . Lead supporting part
86 . . . Contact flat face
88 . . . Inclined face

The invention claimed is:

1. A coil device comprising a coil part having a wire wound around in a coil form, a core part having a magnetic material and a resin and covering entire said coil part including an inside of said coil part, and a terminal electrode installed at an outer face of said core part, wherein a lead part of said wire projects out from the outer face of said core part and a bonding part between said lead part and said terminal electrode is formed at a position spaced apart from said outer face, said terminal electrode comprises a terminal body installed along the outer face of said core body, and a lead supporting part bent from said terminal body towards said bonding part at the position near where said lead part projects out from the outer face of said core part, and a crossing angle θ1 of said lead supporting part with respect to an inner face of said terminal electrode is less than 90 degrees.

2. A coil device comprising a coil part having a wire wound around in a coil form, a core part having a magnetic material and a resin and covering entire said coil part including an inside of said coil part, and a terminal electrode installed at an outer face of said core part, wherein a lead part of said wire projects out from the outer face of said core part and a bonding part between said lead part and said terminal electrode is formed at a position spaced apart from said outer face, said terminal electrode comprises a terminal body installed along the outer face of said core body, and a lead supporting part bent from said terminal body towards said bonding part at the position near where said lead part projects out from the outer face of said core part, and a crossing angle θ2 of said lead supporting part with respect to said lead part is less than 90 degrees.

3. The coil device as set forth in claim 1, wherein an inclined face guiding said lead part on said lead supporting part is formed at a corner part of one side in a width direction of said lead support part from a middle of said lead supporting part to said bonding part.

4. The coil device as set forth in claim 1, wherein a contact flat face substantially parallel to said lead part is formed at a tip part of said lead supporting part.

5. The coil device as set forth in claim 2, wherein a contact flat face substantially parallel to said lead part is formed at a tip part of said lead supporting part.

6. The coil device as set forth in claim 1, wherein said terminal body comprises a main terminal body and a sub terminal body, and said lead support part is formed as one body to said sub terminal body.

7. The coil device as set forth in claim 2, wherein said terminal body comprises a main terminal body and a sub terminal body, and said lead support part is formed integrally to said sub terminal body.

8. The coil device as set forth in claim 6, wherein an installation grove is formed at the outer face of said core part positioned at both sides of a coil axis direction of said coil part, and a resilience peace positioned at both sides of said coil axis direction of said main terminal body is engaged with said installation groove.

9. The coil device as set forth in claim 7, wherein an installation grove is formed at the outer face of said core part positioned at both sides of a coil axis direction of said coil part, and a resilience peace positioned at both sides of said coil axis direction of said main terminal body is engaged with said installation groove.

10. The coil device as set forth in claim 6, wherein at one side of said coil axis direction of said main terminal body, an installation piece installed to one side face of said coil axis direction of said core part is formed integrally to said main terminal body.

11. The coil device as set forth in claim 7, wherein at one side of said coil axis direction of said main terminal body, an installation piece installed to one side face of said coil axis direction of said core part is formed integrally to said main terminal body.

12. The coil device as set forth in claim 2, wherein an inclined face guiding said lead part on said lead supporting part is formed at a corner part of one side in a width direction of said lead support part from a middle of said lead supporting part to said bonding part.

* * * * *